US005347974A

United States Patent [19]

Togai et al.

[11] Patent Number: 5,347,974

[45] Date of Patent: Sep. 20, 1994

[54] AIR-TO-FUEL RATIO CONTROL SYSTEM FOR INTERNAL COMBUSTION ENGINE

[75] Inventors: Kazuhide Togai, Osaka; Tetsurou Ishida; Katsunori Ueda, both of Kyoto, all of Japan

[73] Assignee: Mitsubishi Jidosha Kogyo Kabushi Kaisha, Tokyo, Japan

[21] Appl. No.: 949,881

[22] PCT Filed: Mar. 30, 1992

[86] PCT No.: PCT/JP92/00390

§ 371 Date: Dec. 31, 1992

§ 102(e) Date: Dec. 31, 1992

[87] PCT Pub. No.: WO92/17697

PCT Pub. Date: Oct. 15, 1992

[30] Foreign Application Priority Data

Mar. 28, 1991 [JP] Japan ..... 3-64681
Apr. 17, 1991 [JP] Japan ..... 3-85298

[51] Int. Cl.[5] ..... F02M 51/00; F02D 9/06

[52] U.S. Cl. ..... 123/682; 123/478; 123/325

[58] Field of Search ..... 123/682, 478, 325

[56] References Cited

U.S. PATENT DOCUMENTS

| | | | |
|---|---|---|---|
| 4,320,730 | 3/1982 | Takada et al. | 123/682 |
| 4,913,120 | 4/1990 | Fujimoto et al. | 123/682 |
| 4,922,877 | 5/1990 | Nagaishi | 123/478 |
| 4,958,612 | 9/1990 | Kato et al. | 123/682 |
| 4,981,122 | 1/1991 | Osawa et al. | 123/325 |
| 4,991,559 | 2/1991 | Osawa et al. | 123/682 |

FOREIGN PATENT DOCUMENTS

| | | | |
|---|---|---|---|
| 58-27820 | 2/1983 | Japan | 123/682 |
| 58-027857 | 2/1983 | Japan | 123/682 |
| 58-214649 | 12/1983 | Japan | 123/682 |
| 60-053636 | 3/1985 | Japan | 123/682 |
| 60-195353 | 10/1985 | Japan | 123/682 |
| 60-233329 | 11/1985 | Japan | 123/682 |
| 64-029647 | 1/1989 | Japan | 123/682 |
| 1211638 | 8/1989 | Japan | 123/682 |
| 2007407 | 5/1979 | United Kingdom | 123/682 |

*Primary Examiner*—Raymond A. Nelli

[57] ABSTRACT

An air-to-fuel ratio control system optimally controls an air-to-fuel ratio of an internal combustion engine according to various engine operating conditions, and aims at assuring quick air-to-fuel ratio control and preventing erroneous operation of the engine. With this control system, a corrective amount of fuel to be supplied is determined according to a deviation $\Delta(A/F)$ of a measured air-to-fuel ratio $(A/F)_i$ and a target air-to-fuel ration $(A/F)_{OBJ}$. This corrective amount of the fuel is kept in an allowable range defined by limits $K_{LMIN}$ and $K_{LMAX}$, or $K_{RMIN}$ and $K_{RMAX}$. Therefore, the engine is supplied with the fuel which is controlled according to a target fuel amount $LT_{INJ}$ determined by the correct fuel amount. The control system is responsive to various engine operating conditions, and protects the engine against troubles, damage and interruption, and prevents deterioration of exhaust gases.

22 Claims, 14 Drawing Sheets

AIR-TO-FUEL RATIO CONTROL SYSTEM FOR INTERNAL COMBUSTION ENGINE

FIELD OF THE INVENTION

This invention relates to an air-to-fuel ratio control system for controlling an air-to-fuel ratio of an air-fuel mixture to be supplied to an internal combustion engine, and more particularly to an air-to-fuel ratio control system in which an actual air-to-fuel ratio is detected by an air-to-fuel ratio sensor, and a corrective air-to-fuel ratio is determined based on the detected air-to-fuel ratio so as to remove a deviation of the actual air-to-fuel ratio from the target air-to-fuel ratio, and to let fuel injectors supply the fuel to the engine according to the corrective air-to-fuel ratio.

BACKGROUND OF THE INVENTION

Fuel injectors of an internal combustion engine have to supply a fuel to an engine system in response to operating conditions thereof. It is necessary to keep an air-to-fuel ratio in a narrow area near the stoichiometric ratio, i.e. a target ratio near the stoichiometric ratio, so that a three-way catalytic converter can effectively purify exhaust gases.

In the internal combustion engine, the air-to-fuel ratio depends upon loads and engine speeds. As shown in FIG. 11 of the accompanying drawings, the target air-to-fuel ratio should be determined depending upon whether the engine is operating with an air-to-fuel ratio which is for a fuel cutting zone, a lean zone, a stoichiometric zone or a high acceleration operating zone. There are proposed engines which mainly operate with a lean air-fuel mixture so as to save the fuel.

The air-to-fuel ratio of such an engine is usually set between a target value and the stoichiometric ratio according to the engine operating conditions. In addition, if the target air-to-fuel ratio is extensively variable in the rich and lean zones from the stoichiometric ratio, an exhaust gas purifier has to include not only a three-way catalytic converter but also a catalyst for effectively purifying NOx in lean exhaust gases. Such a catalyst is disposed before the three-way catalytic converter so as to remove NOx from the lean exhaust gases. One of such engines is exemplified in Japanese Patent Laid-Open Publication Sho 60-125250 (1985).

To feedback control this engine, it is essential to obtain data on the air-to-fuel ratio which is extensively variable in the entire engine operating zone. Wide-range air-to-fuel ratio sensors are employed for this purpose. One of such sensors is disclosed in the Japanese Patent Laid-Open Publication Hei 2-204326 (1991).

A control unit for this purpose calculates a corrective air-to-fuel ratio based on actual air-to-fuel ratio data measured by the wide range air-to-fuel ratio sensor and a target air-to-fuel ratio (in the rich and lean zones from the stoichiometric ratio) which is set for a possible engine operating condition. The corrective air-to-fuel ratio removes the deviation of the actual air-to-fuel ratio from the target air-to-fuel ratio. Then, the amount of fuel to be injected is calculated to satisfy the corrective air-to-fuel ratio, so that fuel injectors will deliver the calculated amount of the fuel.

The present invention aims at solving the following problems of conventional air-to-fuel ratio control systems.

When an air-to-fuel ratio sensor or a fuel injector becomes out of use in any of the foregoing air-to-fuel control systems, the air-to-fuel ratio would be erroneously corrected in the feedback control process, with unreliable operation or interruption of the engine being caused, or the engine being damaged due to knocking.

The foregoing inconveniences may be solved by uniformly setting the maximum and minimum allowable ranges of the corrective value in the feedback control. However, since the feedback control capability per step is limited, the air-to-fuel ratio sometimes has to be controlled in a plurality of steps.

With the foregoing prior problems in view, it is an object of the invention to provide an air-to-fuel ratio control system which can effectively prevent over-correction of the air-to-fuel ratio in the feedback control process.

SUMMARY OF THE INVENTION

According to a first aspect of this invention there is provided an air-to-fuel ratio control system for an internal combustion engine, comprising: an air-to-fuel ratio deviation calculating unit for calculating a deviation of a measured air-to-fuel ratio from a target air-to-fuel ratio which is determined according to an engine operating condition;-a corrective fuel amount setting unit for setting the amount of fuel to be corrected from a reference amount of the fuel based on the foregoing air-to-fuel ratio deviation, the reference amount of the fuel being determined according to the engine operating conditions; a corrective amount limit setting unit for setting limits of the corrective value; and a corrective value optimizing unit for determining an optimum maximum or minimum amount of the fuel to be supplied.

According a second aspect of the invention, there is provided an air-to-fuel ratio control system which includes: a target air-to-fuel ratio calculating unit for calculating a target air-to-fuel ratio according to an engine operating condition; a wide-range air-to-fuel ratio sensor located in an exhaust passage; a deviation calculating unit for calculating a deviation of an actual air-to-fuel ratio measured by the wide-range air-to-fuel ratio sensor from the target air fuel ratio calculated by said target air-to-fuel ratio calculating unit; a corrective fuel amount setting unit for setting the amount of fuel to be corrected based on the deviation; a corrective amount limit setting unit for setting limits of the corrective value; a corrective amount optimizing unit for determining an optimum maximum or minimum amount of the fuel to be supplied; a corrective ratio setting unit for determining a corrective air-to-fuel ratio based on the target air-to-fuel ratio and the optimum maximum or minimum amount of the fuel to be supplied; and a reference fuel amount setting unit for determining the reference amount of the fuel based on the corrective air-to-fuel ratio.

With the foregoing arrangement, the air-to-fuel ratio control system of the invention sets the amount of fuel to be corrected from the reference fuel amount according to a deviation of a measured actual air-to-fuel ratio from a target air-to-fuel ratio. The corrective amount of the fuel is determined to be within an allowable limit. Then, the amount of the fuel to be supplied is corrected based on the allowable limit. Thus, an optimum amount of the fuel will be supplied to the engine according to its operating condition, so that the air-to-fuel ratio control system is very responsive to the engine operating condition. When the engine is operating with the optimum air-to-fuel ratio which is optimum for a respective engine operating condition, the engine can be protected against knocking even if the engine is operating in a zone where knocking tends to happen.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

Figure 1:
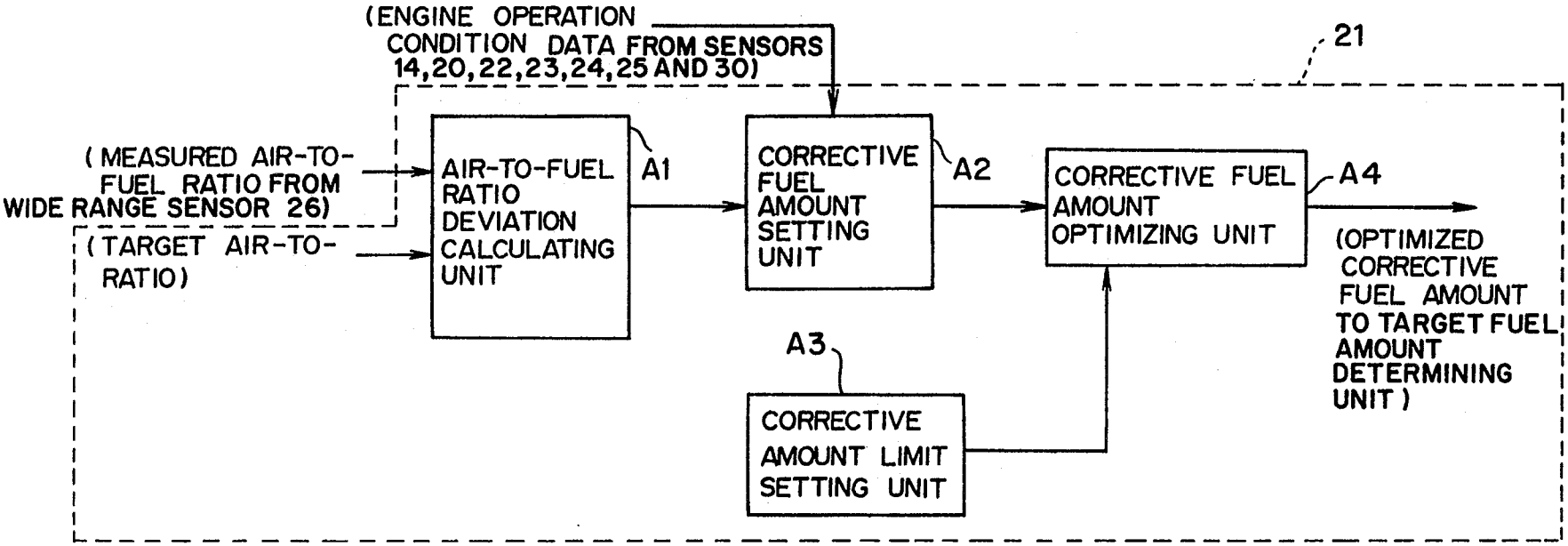
FIG. 1 is a block diagram of an air-to-fuel ratio control system for an internal combustion engine for one embodiment of the present invention.
Figure 6:
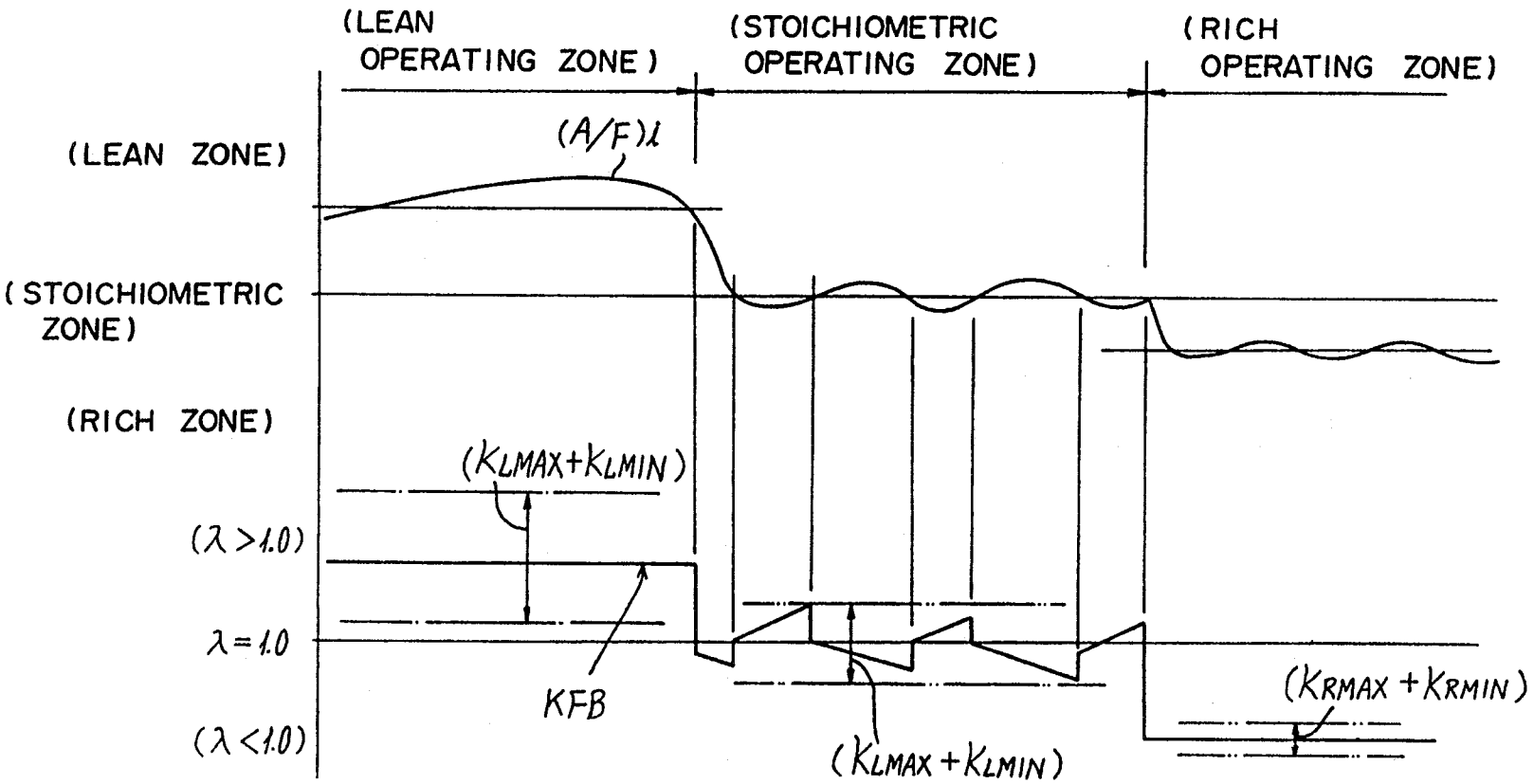
Figure 7:
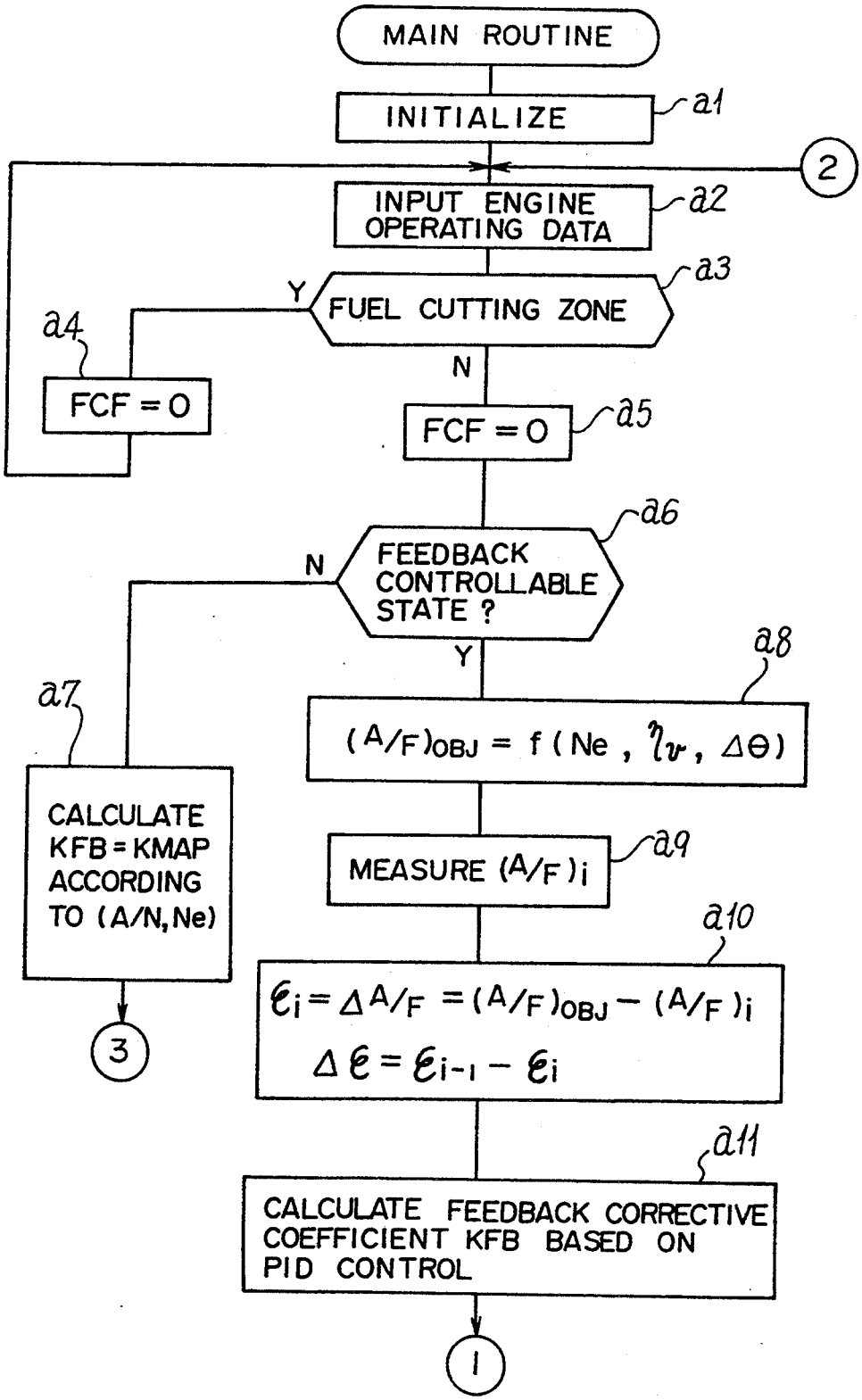
Figure 8:
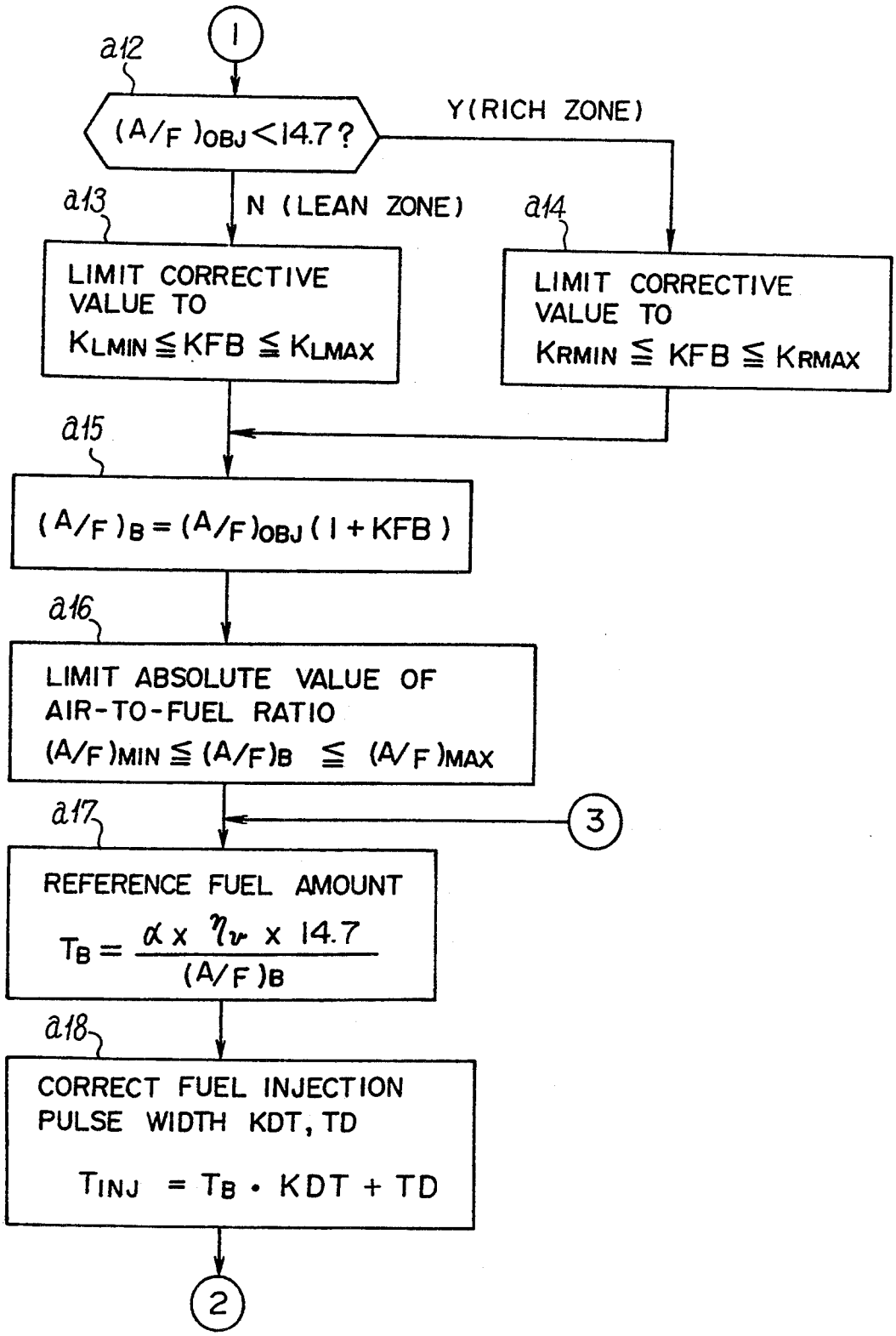
Figure 9:
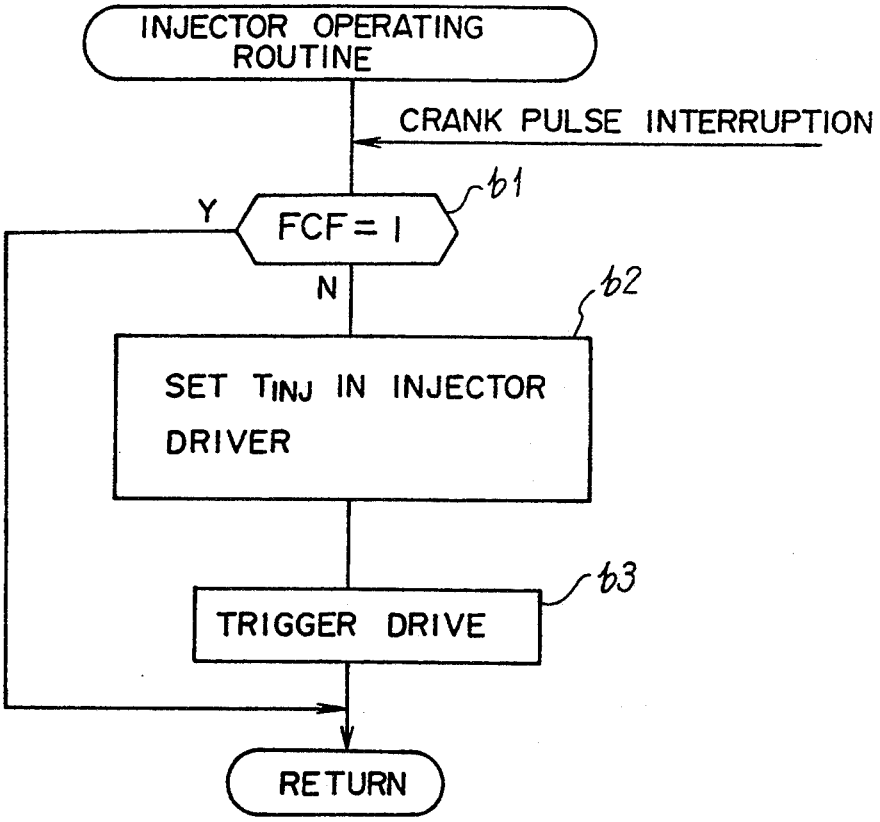
Figure 10:
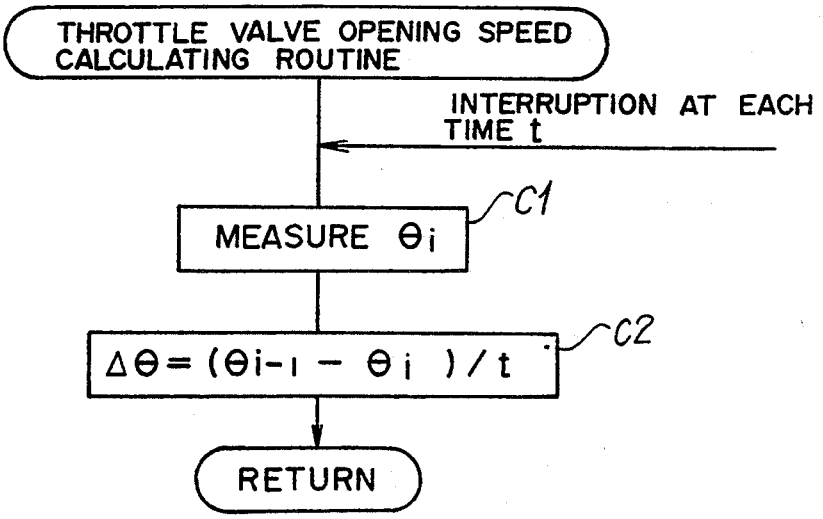
Figure 11:
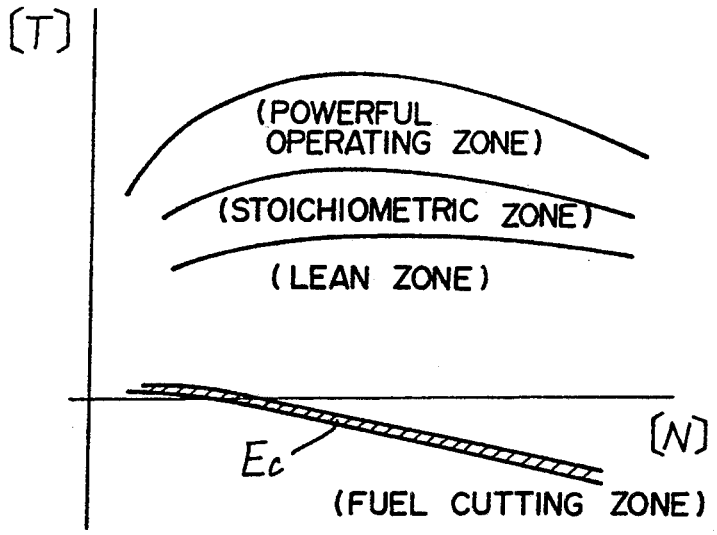
Figure 12:
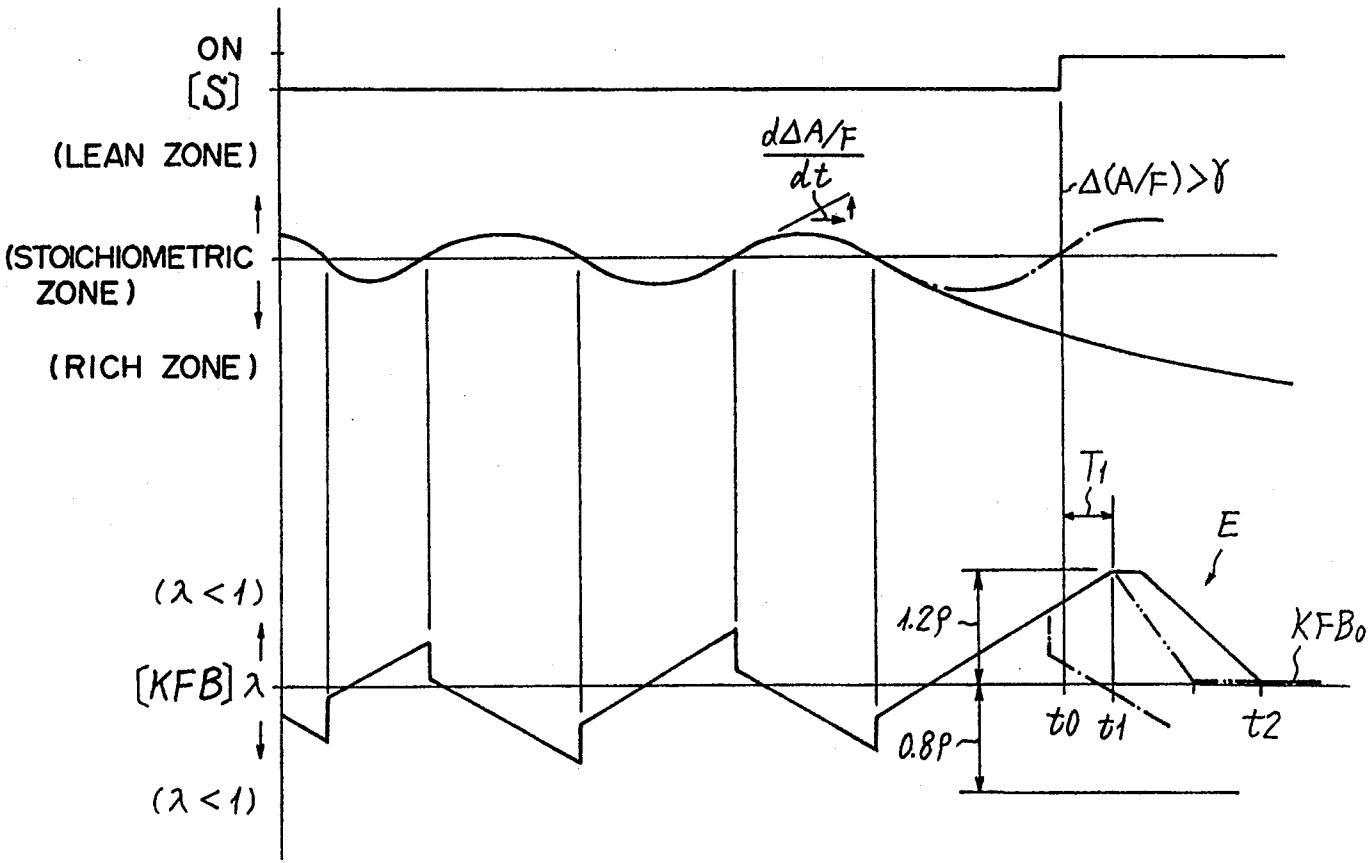
Figure 13:
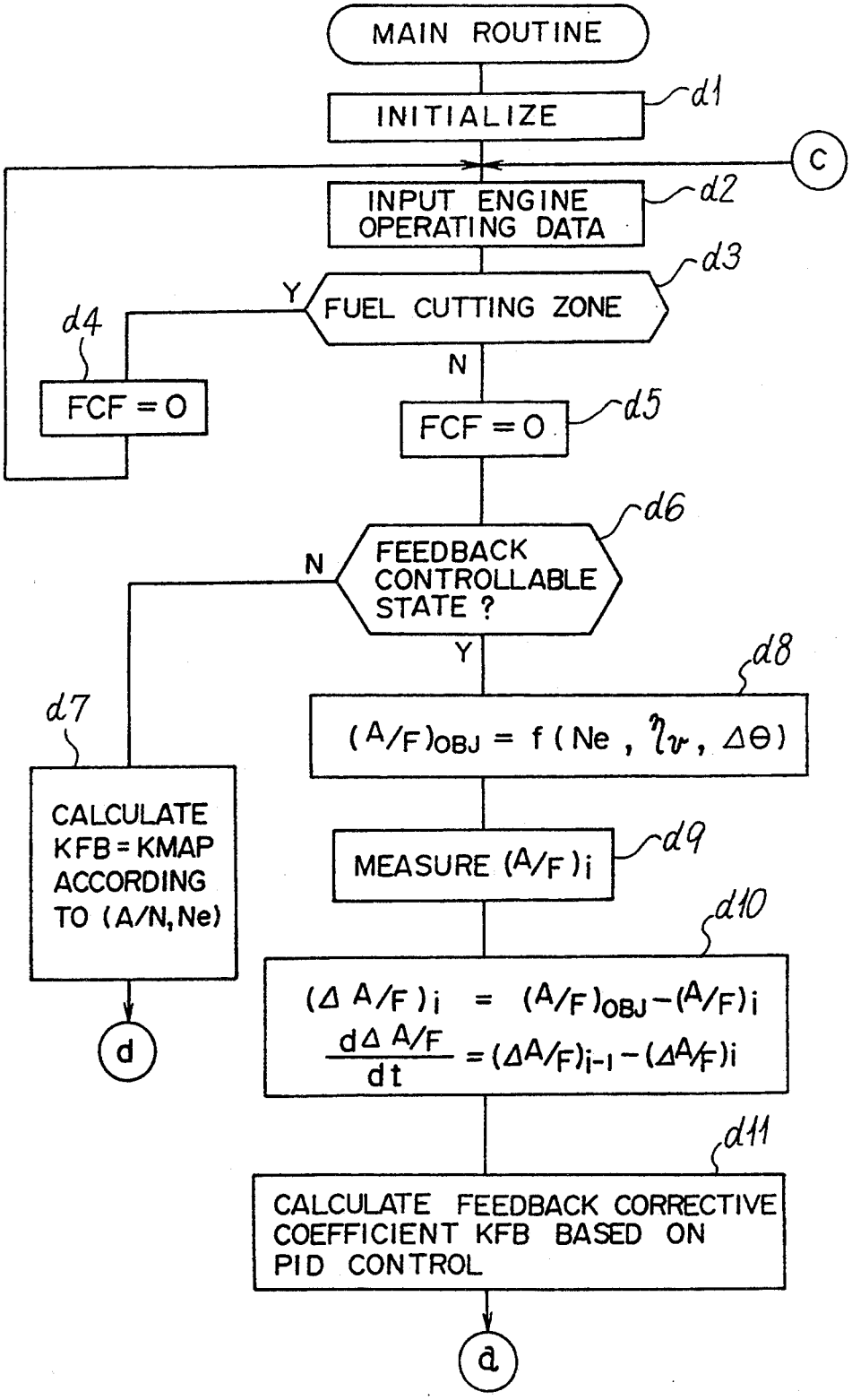
Figure 14:
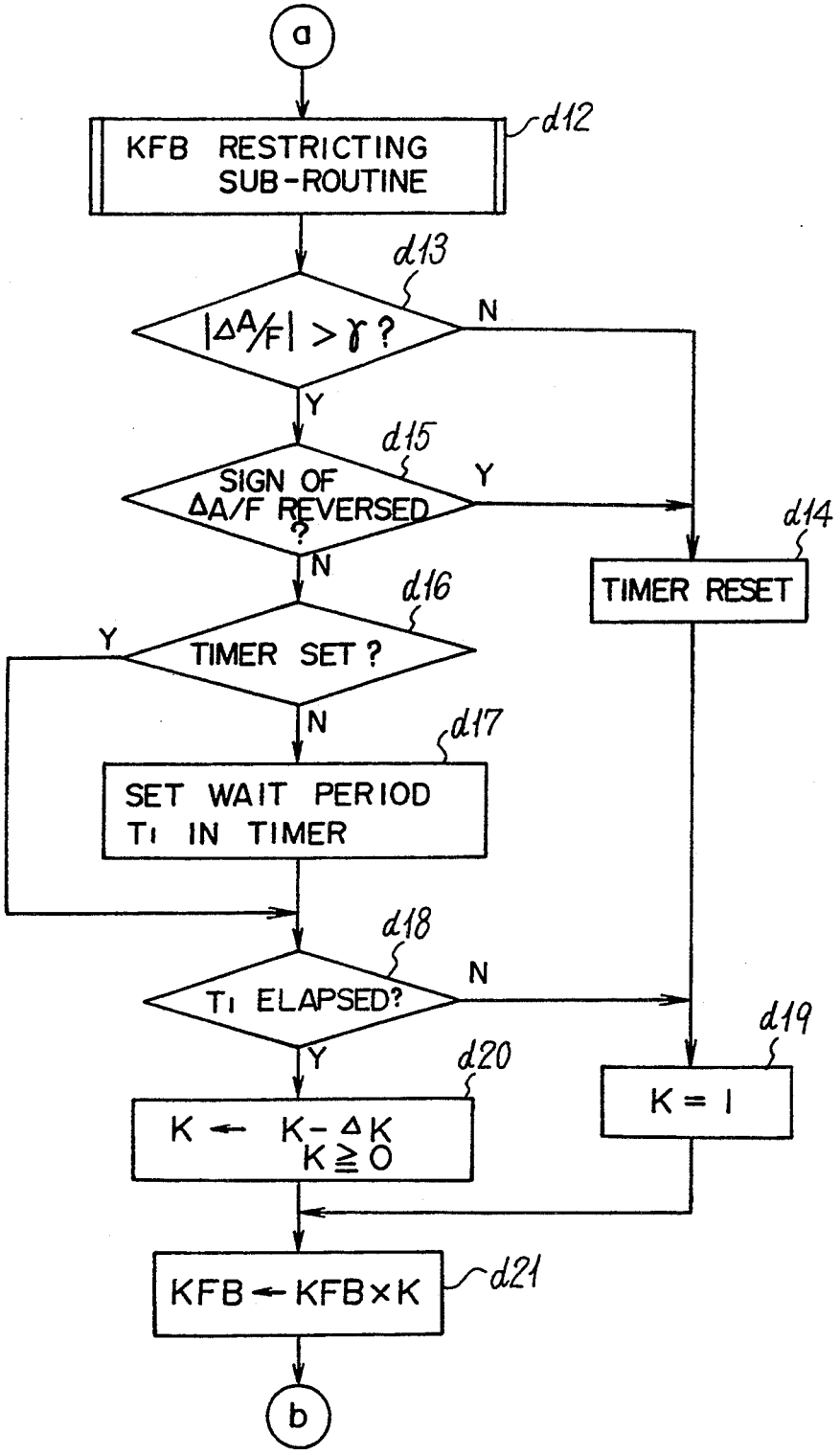
Figure 15:
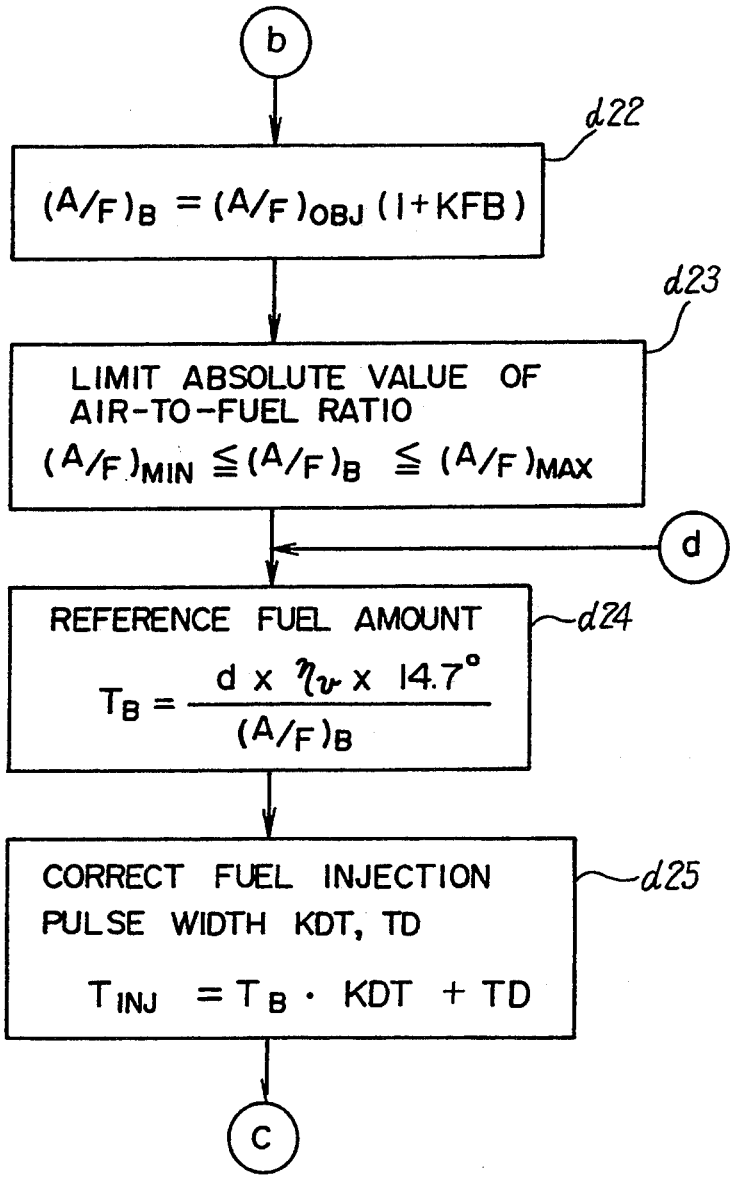
Figure 16:
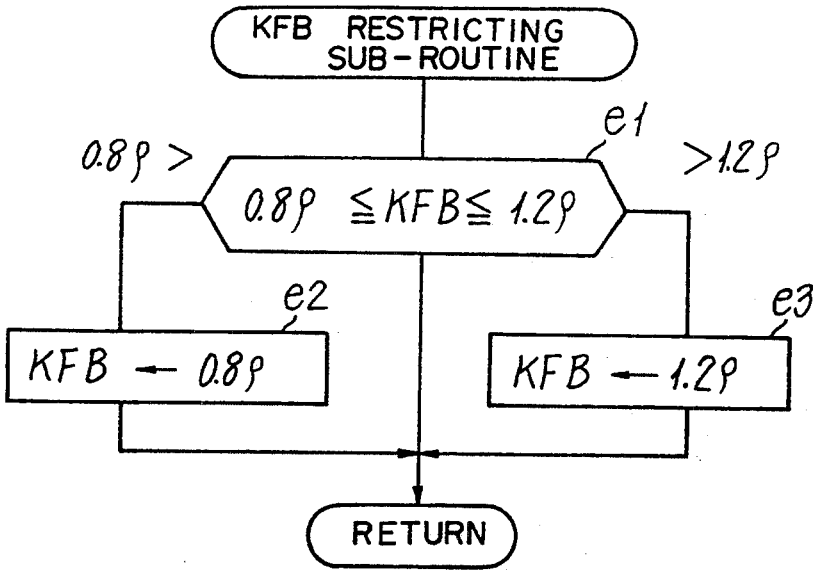

FIG, 5(*b*) is a map for calculating the air-to-fuel ratio when a throttle opening speed corresponds to an engine operating for an acceleration more than a moderate acceleration;

FIG. 6 shows time-depending changes of a measured actual air-to-fuel ratio $(A/F)_i$ and an air-to-fuel ratio correcting coefficient KFB in the system of FIG, 1;

FIGS. 7 and 8 are flowcharts of a main routine of an air-to-fuel ratio control program for the system of FIG, 1;

FIG. 9 is a flowchart of an injector operating routine for the system of FIG. 1;

FIG. 10 is a flowchart of a throttle opening speed calculating routine for system of FIG. 1;

FIG. 11 is a graph showing torque characteristics of an ordinary engine in the entire engine operating zone;

FIG. 12 shows time-depending changes of a measured air-to-fuel ratio $(A/F)_i$ and an air-to-fuel ratio correcting coefficient KFB in an air-to-fuel ratio control system in another embodiment of the invention;

FIGS. 13 to 15 are flowcharts of a main routine for controlling the air-to-fuel ratio in the embodiment of FIG. 12; and FIG. 16 is a flowchart of a subroutine for system of FIG. 12.

DETAILED DESCRIPTION OF PREFERRED EMBODIMENTS

As shown in FIG. 1, an air-to-fuel ratio control system of a first embodiment generally includes an air-to-fuel ratio deviation calculating unit A1, a corrective fuel amount setting unit A2, a corrective amount limit setting unit A3, and a corrective amount optimizing unit A4. Specifically, the air-to-fuel ratio deviation calculating unit A1 calculates a deviation $\Delta(A/F)$ of a measured air-to-fuel ratio $(A/F)_i$ from a target air-to-fuel ratio $(A/F)_{OBJ}$. The corrective fuel amount setting unit A2 determines the amount of a fuel to be corrected from a reference fuel amount based on the foregoing air-to-fuel ratio deviation. The corrective amount limit setting unit A3 sets limits of the corrective value. The corrective amount optimizing unit A4 determines the optimum maximum or minimum amount of the fuel to be supplied.

With the foregoing arrangement, the corrective air-to-fuel ratio $(A/F)_B$ is calculated based on the target air-to-fuel ratio $(A/F)_{OBJ}$ by using an air-to-fuel ratio correcting coefficient KFB, which is determined according to the deviation $\Delta(A/F)$ of the measured air-to-fuel ratio $(A/F)_i$ from the target air-to-fuel ratio $(A/F)_{OBJ}$. In this case, maximum and minimum values of the coefficient KFB, i.e. $K_{LMIN}$, $K_{LMAX}$, $K_{RMIN}$ and $K_{RMAX}$, are appropriately determined to define a maximum or minimum amount of the fuel to be corrected. Then, the optimum maximum or minimum amount of the fuel to be supplied will be determined based on these values. Thus, the optimum amount of the fuel will be supplied according to the determined corrective air-to-fuel ratio, so that the engine can operate most efficiently under respective load conditions.

Figure 2:
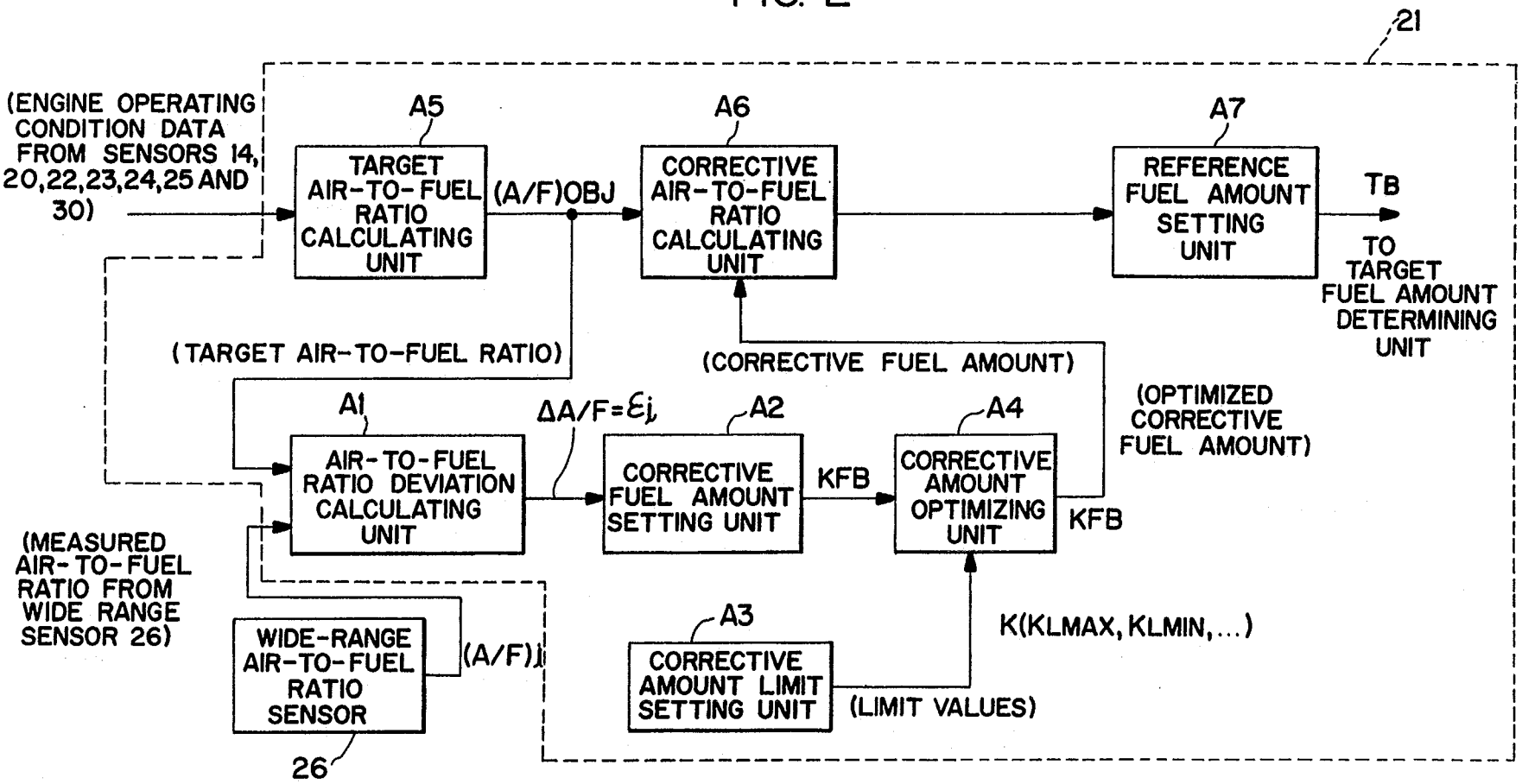
FIG. 2 is a block diagram of an air-to-fuel ratio control system for another embodiment of the present invention.

FIG. 2 shows the configuration of an air-to-fuel ratio control system according to a second embodiment. The air-fuel-ratio control system includes a target ratio calculating unit A5, a wide-range air-to-fuel ratio sensor 26 (located in a scavenge passage), an air-to-fuel ratio deviation calculating unit A1, a corrective fuel amount setting unit A2, a corrective amount limit setting unit A3, a corrective amount optimizing unit A4, a corrective ratio calculating unit A6, and a reference fuel amount determining unit A7. Specifically, the air-to-fuel ratio deviation calculating unit A1 calculates a deviation $\Delta(A/F)$ of a measured air-to-fuel ratio $(A/F)_i$ from a target air-to-fuel ratio $(A/F)_{OBJ}$. The corrective fuel amount setting unit A2 determines the amount of fuel to be corrected (air-to-fuel ratio correcting coefficient KFB) according to the deviation $\Delta(A/F)$. The corrective amount limit setting unit A3 sets limits of the corrective value. The corrective amount optimizing unit A4 determines the optimum maximum or minimum amount of the fuel to be supplied. The corrective ratio calculating unit A6 calculates the corrective air-to-fuel ratio $(A/F)_B$ based on the target air-to-fuel ratio $(A/F)_{OBJ}$ and the optimized corrective amount of fuel to be supplied. The reference fuel amount determining unit A7 determines the reference fuel amount according to the corrective air-to-fuel ratio $(A/F)_B$.

With the second arrangement, the target air-to-fuel ratio $(A/F)_{OBJ}$ is adjusted based on the corrective amount of fuel under respective engine operating conditions so that the corrective air-to-fuel ratio $(A/F)_B$ can be determined, for thereby obtaining the reference fuel amount $T_B$. Thus, the optimum amount of the fuel will be supplied to the engine under its respective operating conditions.

Figure 3:
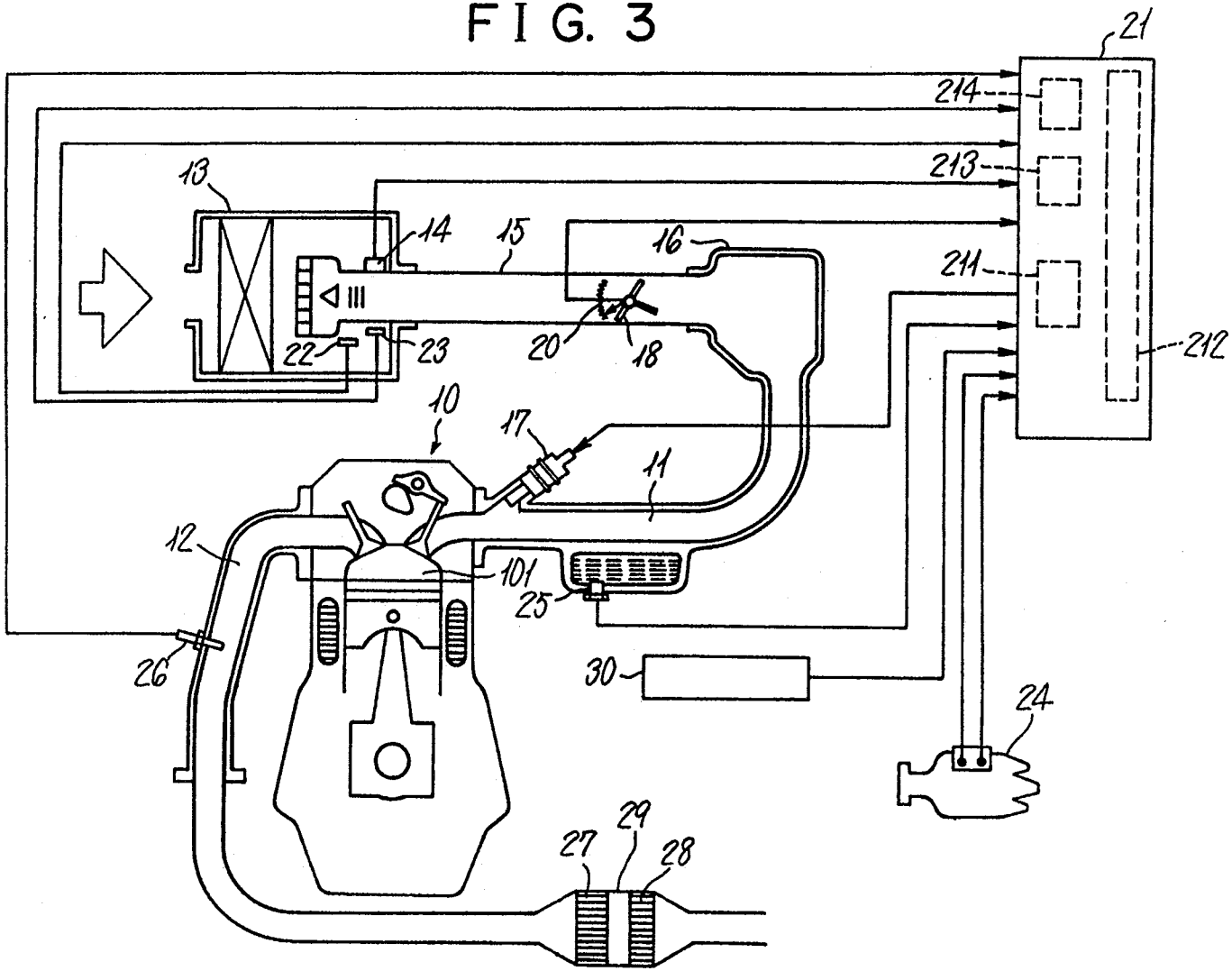
FIG. 3 shows the configuration, partly in cross section, of the air-fuel-ratio control system for an embodiment of this invention.

FIG. 3 shows the air-to-fuel ratio control system of the first embodiment. An engine system 10 includes an air inlet passage 11 and an exhaust passage 12. The air inlet passage 11 is connected to an air cleaner 13 via an inlet pipe 15. An air flow sensor 14 is housed in the air cleaner 13 so as to detect the amount of air flowing into the air cleaner 13. Air is conducted into a combustion chamber 101 of the engine system 10. A surge tank 16 is disposed in the middle of the air inlet passage 11. The fuel is supplied to a downstream side of the surge tank 16 from fuel injectors 17 supported by the engine system 10.

The air inlet passage 11 is opened and closed by a throttle valve 18, which has a throttle sensor 20 to output throttle valve opening data. A voltage value of the throttle sensor 20 is input to an input-output circuit 212 of an electronic controller 21 via a non-illustrated analog-to-digital converter.

In FIG. 3, reference numeral 22 denotes an atmospheric pressure sensor for outputting atmospheric pressure data, 23 denotes an air temperature sensor for outputting air temperature data, and 24 denotes a crankshaft angle sensor for outputting data on a crankshaft angle of the engine system 10. The crankshaft angle sensor 24 serves as an engine speed sensor (Ne sensor). Reference numeral 25 stands for a water temperature sensor for outputting water temperature data of the engine system 10.

A wide range air-to-fuel ratio sensor 26 (hereinafter "wide range sensor 26") is communicated to the scavenge air passage 12, measures an actual air-to-fuel ratio $(A/F)_i$, and outputs the obtained data to the electronic controller 21. In the scavenge air passage 12, a catalyst 27 for purifying NOx in a lean exhaust gas (hereinafter "lean NOx catalyst 27") and a three-way catalytic converter 28 are disposed behind the wide-range sensor 26 in the named order. The lean NOx catalyst 27 and the three-way catalytic converter 28 are housed in a casing 29, behind which a non-illustrated muffler is attached.

When the three-way catalytic converter 28 is heated to be active, it can most efficiently oxidize HC and CO, and reduce NOx in the exhaust gases whose air-to-fuel ratio is near the stoichiometric ratio, for thereby discharging non-toxic exhaust gases. The lean NOx catalyst 27 can reduce NOx when oxygen is excessively supplied in the fuel. As the HC-to-NOx ratio becomes higher, the lean NOx catalyst has a higher NOx purifying ratio ($\eta_{NOX}$).

The input-output circuit 212 of the electronic controller 21 receives the signals output from the wide-range sensor 26, the throttle valve sensor 20, the engine speed sensor 24, the air flow sensor 14, the water temperature sensor 25, the atmospheric pressure sensor 22, the air temperature sensor 23, and the battery voltage sensor 30.

The electronic controller 21 serves as an engine control unit, and is a conventional microcomputer. The electronic controller 21 receives various detection signals, performs a variety of calculations, and provides various control outputs to a driver 211 for operating the fuel injectors 17, and a control circuit 214 for controlling the operation of an ISC valve driver (not shown) and an ignition circuit (not shown). The electronic controller 21 also includes a memory 213 for storing the allowable maximum and minimum values of the air-to-fuel ratio $A_{LMAX}$, $A_{LMIN}$, $A_{RMAX}$, and $A_{RMIN}$, which are shown in FIG. 4, control programs of FIGS. 7 to 10, and the air-to-fuel ratio calculating maps of FIGS. 5(*a*) and 5(*b*).

The electronic controller 21 includes the following units. Specifically, the target ratio calculating unit A5 calculates the target air-to-fuel ratio $(A/F)_{OBJ}$ based on engine operating data. The air-to-fuel ratio deviation calculating unit A1 calculates the deviation $\Delta(A/F)$ of the actual air-to-fuel ratio $(A/F)_i$, based on the output from the wide-range sensor 26, from the target air-to-fuel ratio $(A/F)_{OBJ}$. The corrective fuel amount setting unit A2 determines the amount of the fuel to be corrected according to the air-to-fuel ratio deviation $\Delta(A/F)$. The corrective amount limit setting unit A3 sets the maximum and minimum values of the corrective coefficient KFB, i.e. $K_{LMIN}$, $K_{LMAX}$, $K_{RMIN}$, and $K_{RMAX}$, with respect to allowable ranges of the air-to-fuel ratio, i.e. $A_{LMIN}$, $A_{LMAX}$, $A_{RMIN}$, and $A_{RMAX}$. The corrective amount optimizing unit A4 optimizes the maximum and minimum values of the corrective coefficient KFB, $K_{LMIN}$, $K_{LMAX}$, $K_{RMIN}$, and $K_{RMAX}$, in the predetermined ranges. The corrective air-to-fuel ratio calculating unit A6 calculates the corrective air-to-fuel ratio $(A/F)_B$ based on the target air-to-fuel ratio $(A/F)_{OBJ}$ and the optimized maximum or minimum air-to-fuel ratio correcting coefficient KFB. The reference fuel amount determining unit A7 determines the reference fuel amount $T_B$ based on the corrective air-to-fuel ratio $(A/F)_B$. In addition, a target fuel amount determining unit (not shown) determines a target fuel amount $T_{INJ}$ by adjusting the reference fuel amount $T_B$ according to the engine operating data. A fuel injection controller (not shown) controls the operation of the fuel injectors 17 according to the target fuel amount $T_{INJ}$.

Figure 4:
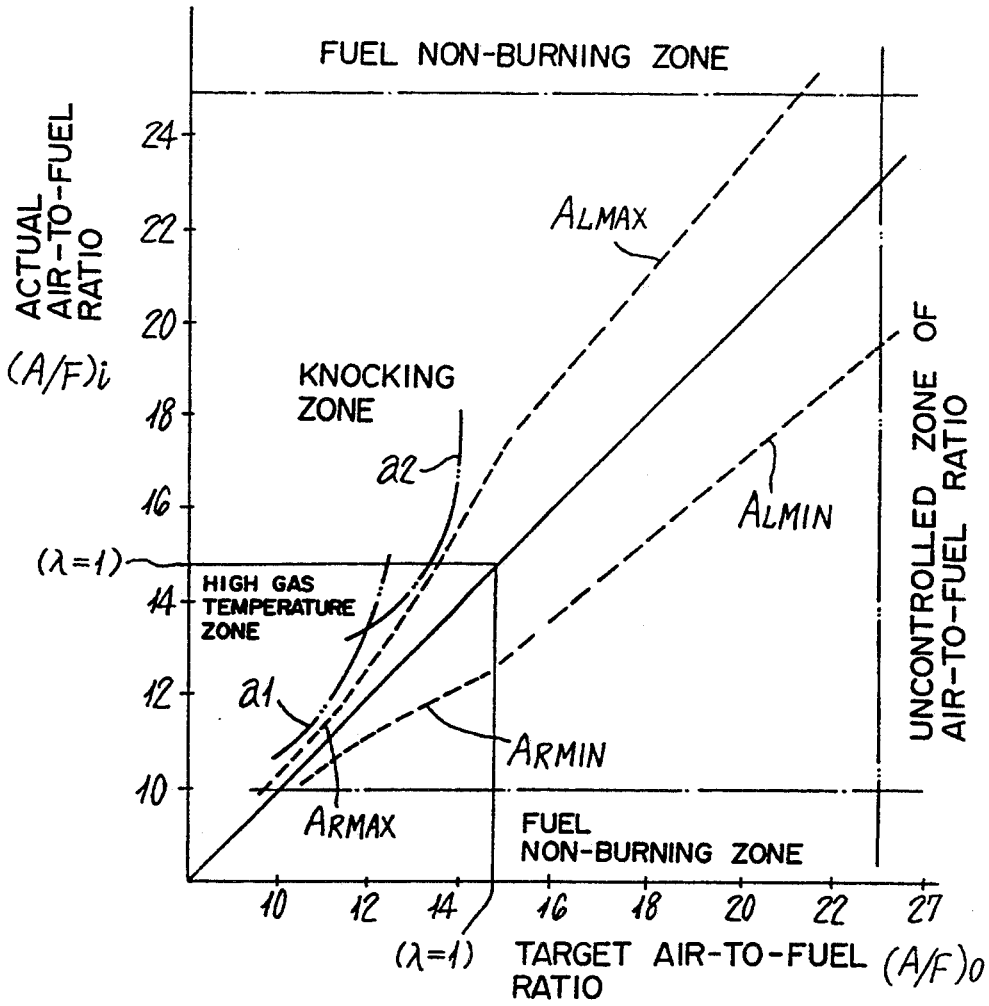
FIG. 4 is a map for determining allowable ranges of a target air-to-fuel ratio $(A/F)_{OBJ}$ used for the system of FIG. 1.

FIG. 4 is a map for determining allowable ranges of the target air-to-fuel ratio $(A/F)_{OBJ}$.

The allowable ranges of the target air-to-fuel ratio $(A/F)_{OBJ}$ are determined in the lean and rich sides, respectively. On the lean side, the allowable range of the target air-to-fuel ratio $(A/F)_{OBJ}$ is relatively wide. The maximum and minimum values of the range are $A_{LMAX}=f1\{(A/F)_{OBJ}\}$ and $A_{LMIN}=f2\{(A/F)_{OBJ}\}$, respectively. On the rich side, the allowable range is relatively narrow. The maximum and minimum values of the range are $A_{RMAX}=f3\{(A/F)_{OBJ}\}$, and $A_{RMIN}=f4\{(A/F)_{OBJ}\}$, respectively. On the lean side, the maximum and minimum values of the correction coefficient KFB, $K_{LMAX}$ and $K_{LMIN}$, are determined in a relatively wide allowable range $|K_{LMAX}-K_{LMIN}|$. On the rich side, the maximum and minimum values of the coefficient KFB, $K_{RMAX\ and\ KRMIN}$, are determined in a relatively narrow allowable range $|K_{RMAX}-K_{RMIN}|$.

The maximum and minimum allowable ranges of the target air-to-fuel ratios, which are $A_{LMAX}$, $A_{LMIN}$, $A_{RMAX}$, and $A_{RMIN}$, are determined by differential functions of first degree f1, f2, f3 and f4 for the rich and lean sides, respectively.

The operation of the air-to-fuel ratio control system will be described with-reference to FIGS. 6, and 7 to 10.

When an ignition key (not shown) is turned on, the values stored in the memory 213 are initialized in step a1 to clear various flags.

In step a2, the memory 213 receives the engine operating conditions such as a measured air-to-fuel ratio $(A/F)_i$, a throttle valve opening signal $\theta_i$, an engine speed signal Ne, an air intake rate signal $Q_i$, a water temperature signal wt, an atmospheric pressure signal Ap, an air temperature signal Ta, and a battery voltage Vb.

Then, it is checked whether or not the engine is in the fuel cutting region Ec (refer to FIG. 11). When the engine is operating in the fuel cutting region Ec, a flag FCF is set at step a4, so that control is returned to step a2. Otherwise, control goes to step a5, the flag FCF is cleared, and control goes to step a6.

In step a6, it is checked whether or not the three-way catalytic converter 28, the lean NOx catalyst 27 and the wide-range sensor 26 have been activated. If the three-way catalytic converter 28, the lean NOx catalyst 27 and the wide-range sensor 26 have not been activated, control goes to step a7, where the engine is not recognized to be under a feedback-controllable operating condition. A map correcting coefficient KMAP associated with the present engine operating data (A/N, Ne) is calculated from the KMAP calculating map (not shown). Then, control returns to the main routine.

When it is found in step a6 that the lean NOx catalyst 27, the three-way catalytic converter 28 and the wide-range sensor 26 have been activated, and when the engine is under the feedback-controllable operating condition, control goes to step a8. In step a8, the target air-to-fuel ratio $(A/F)_{OBJ}$ is calculated based on the engine speed Ne, volume efficiency $\eta v$, and throttle valve opening speed $\Delta\theta$. The throttle valve opening speed $\Delta\theta$ is calculated in the throttle valve opening speed calculating routine which is started at each predetermined timing t as shown in FIG. 10. In this case, a present throttle valve opening $\theta_i$ is input first of all. A difference between the previous throttle valve opening $\theta_{i-1}$ and the present throttle valve opening $\theta_i$ is calculated. The difference is divided by the timing t to obtain the throttle valve opening speed $\Delta\theta$. The stored $\Delta\theta$ is updated at each timing t. When $\Delta\theta$ is more than the predetermined $\Delta\theta a$ (e.g. more than 10° to 12° per second), the engine is considered to be operating at an acceleration more than the moderate acceleration. An excess air ratio $\lambda$ is determined according to the excess air ratio calculating map shown in FIG. 5(*b*), so that a new target air-to-fuel ratio $(A/F)_{OBJ}$ is determined for the present excess air ratio. In other words, the volume efficiency $\eta v$ is calculated based on the volume of the combustion chamber (not shown), the engine speed Ne, the amount of inlet air $A_i$, the atmospheric pressure $A_p$, and the air temperature Ta. Then, the target air-to-fuel ratio is determined based on the volume efficiency $\eta v$ and the engine speed Ne so that the excess air ratio $\lambda$ is equal to 1 or less than 1.0 ($\lambda$=or $\lambda<1.0$).

Figure 5A:
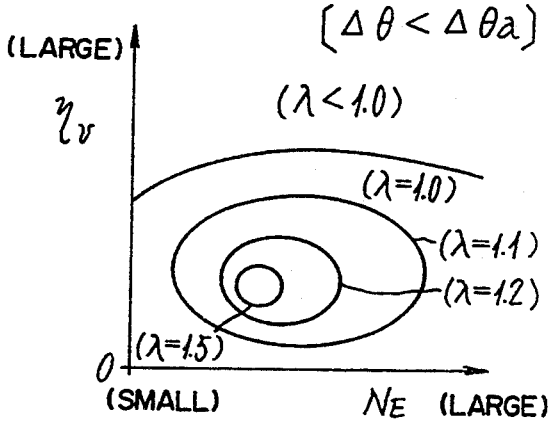
FIG. 5(*a*) is a map for calculating the air-to-fuel ratio when a throttle opening speed corresponds to an engine under a moderate acceleration operating condition.
Figure 5B:
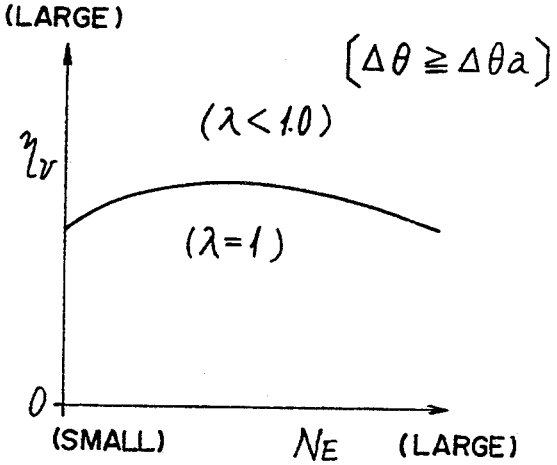

When the throttle valve opening speed $\Delta\theta$ is less than the predetermined $\Delta\theta a$, the excess air ratio $\lambda$ is determined based on the excess air ratio calculating map of FIG. 5(*a*). Then, the target air-to-fuel ratio $(A/F)_{OBJ}$ is calculated based on the excess air ratio $\lambda$. In this case, the volume efficiency $\eta v$ is also calculated. Specifically, the target air-to-fuel ratio is calculated based on the volume efficiency $\eta v$ and the engine speed signal Ne so that the excess air ratio $\lambda$ is basically more than 1, e.g. 1.1, 1.2 or 1.5. The map of FIG. 5(*a*) is used for calculating the excess air ratio $L(=(A/F)_{OBJ}/14.7)$ so as to operate the throttle valve 18 according to the engine operating condition such as a steady speed, moderate or higher acceleration, or at a later stage of acceleration. In other words, the excess air ratio $\lambda$ is set to be more than 1.0 ($\lambda>1.0$) based on the engine speed Ne and the volume efficiency $\eta v$ when the engine is operating steadily. When the throttle valve opening speed $\Delta\theta$ is less than the predetermined $\Delta\theta a$ ($\Delta<\Delta\theta a$), i.e. when the engine is under the moderate acceleration operating condition, the superfluous air ratio $\lambda$ is kept to be more than 1.0 ($\lambda>1.0$). When the throttle valve opening speed $\Delta\theta$ is less than $\Delta\theta a$ in intermediate and later stages of acceleration except for an early acceleration stage (transient stage), the map of FIG. 5(*a*) will be used. In this case, if the throttle valve opening $\theta_i$ is relatively large and the engine speed Ne reaches the maximum value for that throttle valve opening, the excess air ratio $\lambda$ is determined to be equal to 1.0 assuming that the engine is increasing its speed. When the throttle opening $\theta_i$ is nearly maximum and the engine is operating at a full load, the excess air ratio $\lambda$ will be set to be less than 1.0 ($\lambda<1.0$).

Once the target air-to-fuel ratio $(A/F)_{OBJ}$ is determined, control goes to steps a9 and a10. In the step a9, the measured air-to-fuel ratio $(A/F)_i$ is fetched. In step a10, the deviation $\epsilon_i$ ($=\Delta A/F$) of the measured air-to-fuel ratio $(A/F_i)$ from the target air-to-fuel ratio $(A/F)_{OBJ}$, and the difference $\Delta\epsilon$ between the present deviation $\epsilon_i$ and previous deviation $\epsilon_{i-1}$ are calculated. These deviations are input in the specified areas of the memory 213.

The air-to-fuel ratio correcting coefficient KFB is calculated in step a11. In this case, the following are calculated: a proportional term or proportional KP ($\epsilon_i$) according to the deviation $\epsilon_i$, a differential term KD ($\Delta\epsilon$) according to the difference $\Delta\epsilon$, and an integral term $\Sigma$KI ($\epsilon_i$) according to the deviation $\epsilon_i$ and time integration. All of these values are added during the feedback-controllable operating condition, thereby obtaining an air-to-fuel ratio correcting coefficient KFB, which is used to carry out the PID control process shown in FIG. 6.

In step a12, it is checked whether the target air-to-fuel ratio $(A/F)_{OBJ}$ is less than the stoichiometric air-to-fuel ratio 14.7. If the target air-to-fuel ratio $(A/F)_{OBJ}$ is not less than 14.7, i.e. in the lean zone, control goes to step a13. The air-to-fuel ratio correcting coefficient KFB is defined to be $K_{LMIN} \leqq KFB \leqq K_{LMAX}$ so that the target air-to-fuel ratio $(A/F)_{OBJ}$ is kept within the allowable range defined by $A_{LMAX}$ and $A_{LMIN}$. $K_{LMAX}$ and $K_{LMIN}$ represent the maximum and minimum values of the air-to-fuel ratio correcting coefficient KFB with respect to the allowable range $A_{LMAX}$ and $A_{LMIN}$. On the other hand, when the target air-to-fuel ratio $(A/F)_{OBJ}$ is in the rich zone, control goes to step a14. Since the target air-to-fuel ratio $(A/F)_{OBJ}$ is set in the allowable range defined by $A_{RMAX}$ and $A_{RMIN}$, the air-to-fuel ratio correcting coefficient KFB is set to be $K_{RMIN} \leqq KFB \leqq K_{RMAX}$. $K_{RMAX}$ and $K_{RMIN}$ represent the maximum and minimum values of KFB with respect to $A_{RMAX}$ and $A_{RMIN}$. $K_{RMAX}$ and $K_{RMIN}$ are respectively set to be less than $K_{LMAX}$ and $K_{LMIN}$ in a similar manner to $A_{LMAX}$ and $A_{LMIN}$, and $A_{RMAX}$ and $A_{RMIN}$.

When control goes to step a15 from steps a13 and a14, the target air-to-fuel ratio $(A/F)_{OBJ}$ is corrected to increase at the rate of the air-to-fuel ratio correcting coefficient KFB, i.e. is multiplied by (1+KFB), for thereby calculating the corrective air-to-fuel ratio $(A/F)_B$ so as to remove the deviation of the actual air-to-fuel ratio $(A/F)_i$ from the target air-to-fuel ratio $(A/F)_{OBJ}$. Then, control goes to step a16, and defines the corrective air-to-fuel ratio $(A/F)_B$ within the maximum value $(A/F)_{MAX}$ and the minimum value $(A/F)_{MIN}$, for thereby preventing the corrective air-to-fuel ratio $(A/F)_B$ from being adjusted beyond the predetermined range as shown in FIG. 4 (only maximum range is shown).

In step a17, the reference fuel injection amount $T_B$ is calculated by multiplying $\alpha$, 14.7 and $\gamma v$ and by dividing the product by $(A/F)_B$, where $\alpha$ is a constant (injector gain). In step a18, a fuel injection pulse width $T_{INJ}$ is calculated by multiplying $T_B$ and a fuel amount correcting coefficient KDT according to the water temperature wt and the atmospheric pressure Ap, and by adding a voltage correcting coefficient $T_D$ according to the battery voltage $V_b$ (i.e. $T_{INJ}=T_B \times KDT+T_D$). The fuel injection pulse width $T_{INJ}$ (equivalent to target fuel amount) is input in the specified area of the memory 213. Then control returns to step a2.

The injector operating routine of FIG. 9 is carried out independently of the main routine. This injector operating routine is executed to control each fuel injector 17 for each crankshaft angle thereof. The routine will be described hereinafter with respect to one of the fuel injectors 17 as an example.

In step b1, it is checked whether or not the flag FCF has been set while the engine is operating under the fuel cutting condition. If the flag FCF has been set, control returns to the main routine. Otherwise, control goes to step b2. The latest fuel injection pulse width $T_{INJ}$ is set in an injector driver (not shown) connected to the fuel injector 17. Then, the injector driver is triggered in step b3, and control returns to the main routine.

With the air-to-fuel ratio control system of FIG. 1, the air-to-fuel ratio correcting coefficient KFB and the corrective air-to-fuel ratio $(A/F)_B$ are calculated to obviate the deviation of the measured air-to-fuel ratio $(A/F)_i$ from the target air-to-fuel ratio $(A/F)_{OBJ}$. In this case, the air-to-fuel ratio correcting coefficient KFB is defined within the maximum and minimum values $K_{LMAX}$, $K_{LMIN}$, $K_{RMAX}$ and $K_{RMIN}$. Therefore, the amount of fuel to be corrected can be determined with optimum allowance for respective engine operating conditions. In other words, the target air-to-fuel ratio $(A/F)_{OBJ}$ can be controlled in a wide allowable correction range $|A_{LMAX}-A_{LMIN}|$ in the lean zone, for thereby making the control system more responsive. In the rich zone, the allowable correction range $|A_{RMAX}-A_{RMIN}|$ is relatively narrow, for thereby preventing interference with the knock generating zone a2 and the high exhaust gas temperature zone a1, and protecting the engine system against troubles caused by excessive correction of the air-to-fuel ratio, or knocking (refer to FIG. 4).

An air-to-fuel ratio control system according to the second embodiment will be described hereinafter. This control system is substantially identical to the control system shown in FIG. 3 except for the control circuits. Therefore, the identical parts have identical reference numbers, and will not be described in detail.

An electronically controllable injection type engine system 10 includes an electronic controller 21 for controlling devices such as fuel injectors 17, an ignition, and so on.

The electronic controller 21 includes the following units. Specifically, the target ratio calculating unit A5 calculates the target air-to-fuel ratio $(A/F)_{OBJ}$ based on operating conditions of the engine. The air-to-fuel ratio deviation calculating unit A1 calculates the deviation $\Delta(A/F)$ of the measured air-to-fuel ratio $(A/F)_i$ from the target air-to-fuel ratio $(A/F)_{OBJ}$. The corrective fuel amount setting unit A2 determines the amount of the fuel to be corrected according to the deviation $\Delta(A/F)$. The corrective amount limit setting unit A3 sets limits of the corrective value. These limits are defined by $K_{LMIN}$, $K_{LMAX}$, $K_{RMIN}$, and $K_{RMAX}$ for limiting the air-to-fuel ratio coefficient KFB with respect to allowable air-to-fuel ratio ranges $A_{LMIN}$, $A_{LMAX}$, $A_{RMIN}$, and $A_{RMAX}$. The corrective amount optimizing unit A4 determines the optimum maximum and minimum values of the coefficient KFB, $K_{LMIN}$, $K_{LMAX}$, $K_{RMIN}$, and $K_{RMAX}$. The corrective ratio calculating unit A6 determines the corrective air-to-fuel ratio $(A/F)_B$ based on the target air-to-fuel ratio $(A/F)_{OBJ}$ and the optimized air-to-fuel ratio correcting coefficient KFB. The reference fuel amount determining unit A7 determines the reference fuel amount $T_B$ based on the corrective air-to-fuel ratio $(A/F)_B$. In addition, a fuel injection controller (not shown) controls the fuel injectors 17 so as to inject the fuel according to the reference fuel amount $T_B$.

Specifically, the corrective amount limit setting unit A3 includes a judging unit and a unit for gradually diminishing the limit value K. When it is recognized that a period in which the deviation $\Delta(A/F)$ is more than the predetermined deviation $\gamma$ and lasts longer than the predetermined period $T_1$, the judging unit means outputs a time lapse signal. The limit value diminishing unit gradually diminishes the limit value K as the deviation $\Delta(A/F)$ becomes less than the predetermined deviation $\gamma$. The limit value diminishing unit also diminishes the limit value K until the fuel amount to be corrected (air-to-fuel ratio correcting coefficient KFB) becomes substantially zero or becomes equal to zero.

The operation of this air-to-fuel ratio control system will be described with reference to FIGS. 12, and 13 to 16.

When a non-illustrated ignition key is turned on, the electronic controlling unit (ECU) 21 receives, in step d1, data such as initial values of the flags, timers T1 and T2 and so forth in the associated areas of the memory 213.

In step d2, the memory 213 receives the data on present engine operating conditions such as the actual air-to-fuel ratio $(A/F)_i$, the throttle valve opening signal $\theta_i$, the engine speed Ne, the air intake rate signal $Q_i$, the water temperature signal wt, the atmospheric pressure signal Ap, the air temperature Ta and the battery voltage Vb.

In step d3, it is checked whether the engine is operating under the fuel cutting zone EC (FIG, 11). If the engine is in the fuel cutting zone Ec, a flag FCF is set at step a4. Then control returns to the step d2. Otherwise, control goes to step d5, in which the flag FCF is cleared. Then control goes to step d6.

In step d6, it is checked whether the three-way catalytic converter 28, the lean NOx catalyst 27 and the wide-range sensor 26 have been activated. If they have not been activated, controls goes to step d7. In step d7, the engine is recognized under the feedback-non-controllable operating condition. A map correcting coefficient KMAP is calculated, by using the KMAP calculating map (not shown) corresponding to the present operating condition of the engine (such as A/N and Ne). Then control returns to the main routine.

When feedback control of the air-to-fuel ratio is judged to be possible in step d6, control goes to step d8. In step d8, the target air-to-fuel ratio $(A/F)_{OBJ}$ is calculated based on the engine speed Ne, the volume efficiency $\eta v$, and the throttle valve opening speed $\Delta\theta$. The throttle valve opening speed $\Delta\theta$ is calculated in the throttle valve opening speed calculating routine shown in FIG. 10. This routine is periodically started at each predetermined time t. First of all, the electronic control unit receives the present throttle opening. $\theta_i$. A difference between the present throttle opening $\theta_i$ and the previous throttle opening $\theta_{i-1}$ is calculated. This difference is divided by the time t to obtain the throttle valve opening speed $\Delta\theta$. The previously stored $\Delta\theta$ is updated each time t. When $\Delta\theta$ is more than the predetermined $\Delta\theta a$ (e.g. more than 10° to 12°/sec), the engine is judged to be operating at an acceleration more than the moderate acceleration. An excess air ratio $\lambda$ is determined according to the excess air ratio calculating map shown in FIG. 5(*b*), so that a new target air-to-fuel ratio $(A/F)_{OBJ}$ is determined with respect to the present excess air ratio. In this case, the volume efficiency $\eta v$ is calculated based on the volume of the combustion chamber (not shown), the engine speed Ne, the amount of inlet air $A_i$, the atmospheric pressure Ap, and the air temperature Ta. Then, the target air-to-fuel ratio is determined based on the volume efficiency $\eta v$ and the engine speed Ne so that the excess air ratio $\lambda$ is equal to 1 or less than 1.0.

When the throttle valve opening speed $\Delta\theta$ is less than the predetermined $\Delta\theta a$, the excess air ratio $\lambda$ is determined based on the excess air ratio calculating map of FIG. 5(*a*). Then, the target air-to-fuel ratio $(A/F)_{OBJ}$ is calculated based on the excess air ratio $\lambda$. In this case, the volume efficiency $\eta v$ is also calculated. Specifically, the target air-to-fuel ratio is calculated based on the volume efficiency $\eta v$ and the engine speed signal Ne so that the excess air ratio $\lambda$ is basically more than 1, e.g. 1.1, 1.2 or 1.5. The map of FIG. 5(*a*) is used for calculating the superfluous air ratio $\lambda(=(A/F)_{OBJ}/14.7)$ so as to operate the throttle valve 18 according to the engine operating conditions such as the steady speed, the moderate or higher acceleration, or at the later stage of acceleration. In other words, the excess air ratio $\lambda$ is set to be more than 1.0 ($\lambda>1.0$) based on the engine speed Ne and the volume efficiency $\eta v$ when the engine is operating steadily. When the throttle opening speed $\Delta\theta$ is less than the predetermined $\Delta\theta a$ ($\Delta\theta<\Delta\theta a$), i.e. when the engine is under the moderate acceleration operating condition, the excess air ratio $\lambda$ is kept to be more than 1.0 ($\lambda>1.0$). When the throttle valve opening speed $\Delta\theta$ is less than $\Delta\theta a$ in intermediate and later stages of acceleration except for the early stage of acceleration (transient stage), the map of FIG. 5(*a*) will be used. In this case, if the throttle valve opening $\theta_i$ is relatively large and the engine speed Ne reaches the maximum value for that throttle valve opening, the excess air ratio $\lambda$ is determined to be equal to 1.0 assuming that the engine is accelerating. When the throttle opening $\theta_i$ is nearly maximum and the engine is operating at the full load, the excess air ratio $\lambda$ will be determined to be less than 1.0.

Once the target air-to-fuel ratio $(A/F)_{OBJ}$ is determined, control goes to steps d9 and a10. In the step d9, the actual air-to-fuel ratio $(A/F)_i$ is fetched by the wide range sensor 26. In step d10, the deviation $\epsilon_i(=\Delta A/F)$ of the actual air-to-fuel ratio $(A/F)_i$ from the target air-to-fuel ratio $(A/F)_{OBJ}$, and the difference $\Delta_\epsilon$ between the present deviation $\epsilon_i$ and previous deviation $\epsilon_{i-1}$ are calculated. These values are input in the specified areas of the memory 213.

The air-to-fuel ratio correcting coefficient KFB is calculated in step d11. In this case, the following are calculated; a proportional term or proportional KP ($\epsilon_i$) according to the deviation $\epsilon_i$, a differential term KD ($\Delta\epsilon$) according to the difference $\Delta\epsilon$, and an integral term $\Sigma$KI ($\epsilon_i$) according to the deviation $\epsilon_i$ and time integration. All of these values are added during the feedback-controllable operating condition, thereby obtaining an air-to-fuel ratio correcting coefficient KFB, which is used to carry out the PID control process shown in FIG. 6.

In step d12, a KFB control sub-routine is started to control the air-to-fuel ratio correcting coefficient KFB. As shown in FIG. 16, it is checked whether or not KFB is within the allowable range (±20% of the reference value $\rho(=1)$), i.e. $0.8\rho \leqq KFB \leqq 1.2\rho$. If KFB is more than $1.2\rho$, control goes to step e$\epsilon$. If KFB is less than $0.8\rho$, control goes to step d2. If $0.8\rho \leqq KFB \leqq 1.2\rho$, control returns to the main routine. In step e3, KFB is set to $1.2\rho$. In step e2, KFB is set to $0.8\rho$. Then, control returns to the main routine.

Control goes to step d13 from the KFB control subroutine. In step d13, it is checked whether the absolute value of the deviation $\Delta(A/F)$ is more than or less than the predetermined value $\gamma$. If $\Delta(A/F)$ is equal to or less than $\gamma$, control goes to step d14 to reset the timers T1 and T2. In step d19, K is set to 1. Control goes to step d21. If $\Delta(A/F)$ is greater than $\gamma$ in the step d13, control goes to step d15. In step d15, it is checked whether the sign of $\Delta(A/F)$ is reversed. If the sign of $\Delta(A/F)$ is reversed, control goes to the step d14 to reset the timer T1. If the sign of $\Delta(A/F)$ is not reversed, control goes to step d16. In step d16, it is checked whether the timer T1 for detecting the time lapse has been set. If the timer T1 has not been set, control goes to step d17 to set the timer T1. If the timer T1 has been set, control goes to step d18 to check whether the predetermined time period T1 has lapsed. When the time period T1 has not lapsed, control goes to step d19 to make K=1, and goes to step d21. If the time period T1 has lapsed, control goes to step d20.

In step d20, the specified quantity $\Delta K$ is subtracted from K, and control goes to the step d21. In the step d21, the coefficient KFB is corrected by multiplying K.

The foregoing process implies that the coefficient KFB is gradually decreased with lapse of time. As shown at the control zone E of FIG. 12, even when the measured air-to-fuel ratio $(A/F)_i$ becomes larger, the coefficient KFB gradually converges to zero (0) after the time point t1.

As $\Delta K$ becomes larger, the coefficient t2 KFB takes shorter time to converge to KFBo. KFBo may be set within 1% to 3% in the rich zone from the stoichiometric ratio.

In step d22, the target air-to-fuel ratio $(A/F)_{OBJ}$ is corrected to increase at the rate of the coefficient KFB, i.e. multiplied by (1+KFB), for thereby calculating a corrective air-to-fuel ratio $(A/F)_B$ to remove the deviation of the actual air-to-fuel ratio $(A/F)_i$ from the target air-to-fuel ratio $(A/F)_{OBJ}$. Thereafter, a process for defining the absolute value of the corrective air-to-fuel ratio will be started so as to strictly keep the $(A/F)_B$ within the predetermined range. For this purpose, the minimum and maximum air-to-fuel ratios $(A/F)_{min}$ and $(A/F)_{max}$ have been experimentally determined.

In step d24, the reference amount $T_B$ of fuel to be injected is calculated by multiplying the injector gain $\alpha$, $14.7/(A/F)_B$ and volume efficiency $\eta V$. In step d25, the fuel injection pulse width $T_{INJ}$ (equivalent to the target fuel amount) is calculated by multiplying $T_B$ and the air-to-fuel ratio correcting coefficient KDT (according to the water temperature wt and atmospheric pressure Ta), and by adding a voltage correcting coefficient $T_D$, i.e. $T_{INJ}=T_B\times KDT+TD$. $T_{INJ}$ is inputted into the specified area of the memory. Then control returns to the main routine.

The injector driving routine shown in FIG. 9 is carried out for each predetermined crankshaft angle independently of the main routine so as to control the fuel injection process. The latest fuel injection pulse width $T_{INJ}$ is set in the injector driver (not shown) connected to the fuel injectors 17. Then, the driver will be triggered, so that control returns to the main routine.

According to the second embodiment shown in FIGS. 12 to 16, the air-to-fuel ratio control system can control the amount of the fuel to be supplied to the engine according to the target fuel amount $T_{INJ}$ which is calculated by using the air-to-fuel ratio correcting coefficient KAF. Therefore, the optimum amount of the fuel can be supplied in response to the engine operating conditions. Specifically, when the deviation DD (A/F) is more than the preset value $\gamma$, the feedback correction coefficient KAF is converged to zero (0) with lapse of time. Therefore, if the actual air-to-fuel ratio $(A/F)_i$ is abnormal, the feedback control process is interrupted to calculate the target fuel amount $T_{INJ}$ corresponding to the target air-to-fuel ratio $(A/F)_{OBJ}$, and to control the amount of the fuel to be supplied. Therefore, the engine can operate substantially without any trouble, damage or interruption, and can emit cleaner exhaust gases.

APPLICABLE FIELDS

According to this invention, the air-to-fuel ratio control system can optimally control the air-to-fuel ratio in response to the engine operating conditions. Levels of the feedback correction coefficient are corrected, so that the air-to-fuel ratio is adjusted based on the corrected feedback correction coefficient. Since the air-to-fuel ratio control system is very responsive and is substantially free from errors, the system is applicable to engines which include electronically controlled fuel supply devices. The control system can demonstrate its features when it is applied to an engine which is operated in a lean air-fuel mixture and the air-fuel-ratio is controlled by an air-to-fuel ratio sensor.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. An air-to-fuel ratio control system for an internal combustion engine, comprising:

a wide-range air-to-fuel ratio sensor located in an exhaust passage of the internal combustion engine for measuring an air-to-fuel ratio;

target air-to-fuel ratio calculating means for calculating a target air-to-fuel ratio which is determined according to operating conditions of the internal combustion engine;

air-to-fuel ratio deviation calculating means, operatively communicative with said wide-range air-to-fuel ratio sensor and said target air-to-fuel ratio calculating means, for calculating a deviation between the measured air-to-fuel ratio by said wide-range air-to-fuel ratio sensor and said target air-to-fuel ratio for setting a deviation signal;

corrective fuel amount setting means, operatively communicative with said air-to-fuel ratio deviation calculating means for changing the amount of fuel to be supplied from said deviation signal calculated by said air-to-fuel ratio deviation calculating means;

corrective amount limit setting means for setting at least one maximum corrective limit value according to said target air-to-fuel ratio; and corrective amount optimizing means, operatively communicative with said corrective amount limit setting means and said corrective fuel amount setting means, for determining an optimum amount of fuel to be supplied within said corrective limit value based on the amount of fuel set by said corrective fuel amount setting means.

2. An air-to-fuel ratio control system according to claim 1, wherein said corrective amount limit setting means sets a narrow limit when the target air-to-fuel ratio is in a rich zone and a wide limit when the target air-to-fuel ratio is in a lean zone.

3. An air-to-fuel ratio control system according to claim 2, wherein said corrective amount limit setting means determines said narrow and wide limits based on differential equations of first degree.

4. An air-to-fuel ratio control system according to claim 1, wherein said corrective amount limit setting means includes judging means for determining whether a period during which said deviation of the air-to-fuel ratio is more than a predetermined deviation lasts longer than a preset period of time and for outputting a time lapse signal, and limit diminishing means for gradually diminishing said deviation of the air-to-fuel ratio until said deviation of the air-to-fuel ratio becomes less than the predetermined value.

5. An air-to-fuel control system according to claim 4, wherein said limit diminishing means diminishes said deviation of the air-to-fuel ratio until the amount of fuel to be corrected becomes equal to zero or substantially zero.

6. An air-to-fuel ratio control system for an internal combustion engine, comprising:

target air-to-fuel ratio calculating means for calculating a target air-to-fuel ratio according to operating conditions of the internal combustion engine;

a wide-range air-to-fuel ratio sensor located in an exhaust passage for measuring an actual air-to-fuel ratio;

deviation calculating means, operatively communicative with said wide-range air-to-fuel ratio sensor and said target air-to-fuel ratio calculating means, for calculating a deviation between said actual air-to-fuel ratio measured by said wide-range air-to-fuel ratio sensor and said target air-to-fuel ratio calculated by said target air-to-fuel ratio calculating means;

corrective fuel amount setting means, operatively communicative with said deviation calculating means, for changing the amount of fuel to be supplied based on said deviation of the air-to-fuel ratio calculated by said deviation calculating means;

corrective amount limit setting means for setting at least one corrective value according to the target air-to-fuel ratio;

corrective amount optimizing means, operatively communicative with said corrective amount limit setting means and said corrective fuel amount setting means, for determining an optimum amount of the fuel to be supplied within said corrective limit value based on the amount of fuel set by said corrective fuel amount setting means;

corrective ratio setting means, operatively communicative with said target air-to-fuel ratio calculating means and said corrective amount optimizing means, for determining a corrective air-to-fuel ratio based on said target air-to-fuel ratio and said optimum amount of the fuel to be supplied; and reference fuel amount setting means, operatively communicative with said corrective ratio setting means, for determining a reference amount of the fuel based on said corrective air-to-fuel ratio.

7. An air-to-fuel ratio control system according to claim 6, wherein said target air-to-fuel ratio calculating means includes first means for setting said target air-to-fuel ratio close to the stoichiometric ratio, second means for setting said target air-to-fuel ratio appropriately in a lean zone, and third means for determining when the engine is operating under slow acceleration, wherein said target air-to-fuel ratio set by said second means is used when the engine is determined to be operating in slow acceleration.

8. An air-to-fuel ratio control system according to claim 7, wherein said third means determines that the engine is operating in slow acceleration when a throttle valve opening per unit time is larger than zero but less than a predetermined value.

9. An air-to-fuel ratio control system according to claim 7, wherein said target air-to-fuel ratio calculating means calculates the target air-to-fuel ratio based on at least a speed and volume efficiency of the engine operating conditions.

10. An air-to-fuel ratio control system according to claim 6, wherein said corrective amount limit setting means sets a narrow limit when the target air-to-fuel ratio is in a rich zone and a wide limit when the target air-to-fuel ratio is in a lean zone.

11. An air-to-fuel ratio control system according to claim 10, wherein said corrective amount limit setting means sets said narrow and wide limits based on differential equations of first degree.

12. An air-to-fuel ratio control system according to claim 6, wherein said corrective amount limit setting means includes judging means for determining whether a period during which said deviation of the air-to-fuel ratio is more than a predetermined deviation of the air-to-fuel ratio lasts longer than a preset period of time and for outputting a time lapse signal, and limit diminishing means for gradually diminishing said deviation of the air-to-fuel ratio until said deviation of the air-to-fuel ratio becomes less than the predetermined deviation of the air-to-fuel ratio.

13. An air-to-fuel ratio control system according to claim 12, wherein said limit diminishing means diminishes said deviation of the air-to-fuel ratio until the amount of fuel to be corrected becomes equal to zero or substantially zero.

14. A method for controlling an air-to-fuel ratio in an internal combustion engine, comprising the steps of:

(a) measuring an air-to-fuel ratio in an exhaust passage of the internal combustion engine;

(b) calculating a target air-to-fuel ratio according to operating conditions of the internal combustion engine;

(c) calculating a deviation between said air-to-fuel ratio measured at said step (a) and said target air-to-fuel ratio calculated at said step (b);

(d) changing an amount of fuel to be supplied from said deviation calculated at said step (c);

(e) setting at least one maximum corrective limit value according to said target air-to-fuel ratio; and (f) determining an optimum amount of fuel to be supplied within said corrective limit value based on the amount of fuel set at step (d).

15. A method according to claim 14, wherein said step (e) sets a narrow limit when the target air-to-fuel ratio is in a rich zone and a wide limit when the target air-to-fuel is in a lean zone.

16. A method according to claim 15, wherein said step (e) determines said narrow and wide limits based on differential equations of first degree.

17. A method according to claim 14, wherein said step (e) further comprises the steps of:

(e)(1) determining whether a period during which said deviation of the air-to-fuel ratio is more than a predetermined deviation lasts longer than a preset period of time and outputting a time lapse signal; and (e)(2) gradually diminishing said deviation of the air-to-fuel ratio until said deviation of the air-to-fuel ratio becomes less than the predetermined value.

18. A method according to claim 17, wherein said step (e)(2) diminishes said deviation of the air-to-fuel ratio until the amount of fuel to be corrected becomes equal to or substantially zero.

19. A method according to claim 14, further comprising the steps of:

(g) determining a corrective air-to-fuel ratio based on said target air-to-fuel ratio and said optimum amount of fuel to be supplied; and (h) determining the amount of fuel to be supplied based on said corrective air-to-fuel ratio.

20. A method according to claim 14, wherein said sep (b) further comprises the steps of:

(b)(1) setting said target air-to-fuel ratio close to the stoichiometric ratio;

(b)(2) setting said target air-to-fuel ratio appropriately in a lean zone; and (b)(3) determining when the engine is operating under slow acceleration, wherein said target air-to-fuel ratio set at said step (b)(2) is used when the engine is determined to be operating in slow acceleration.

21. A method according to claim 20, wherein said step (b)(3) determines that the engine is operating in slow acceleration when a throttle valve opening per unit time is larger than zero but less than a predetermined value.

22. A method according to claim 20, wherein said step (b) calculates the target air-to-fuel ratio based on at least a speed and volume efficiency of the engine operating conditions.

* * * * *